US010096208B2

(12) United States Patent
Caputo et al.

(10) Patent No.: US 10,096,208 B2
(45) Date of Patent: Oct. 9, 2018

(54) GAMING SYSTEM AND METHOD FOR PERMANENTLY INCREASING THE AVERAGE EXPECTED PAYBACK PERCENTAGE OF A GAME FOR A PLAYER

(71) Applicant: IGT, Las Vegas, NV (US)

(72) Inventors: Scott A. Caputo, Santa Clara, CA (US); Mark C. Nicely, Daly City, CA (US)

(73) Assignee: IGT, Las Vegas, NV (US)

( * ) Notice: Subject to any disclaimer, the term of this patent is extended or adjusted under 35 U.S.C. 154(b) by 13 days.

(21) Appl. No.: 15/383,225

(22) Filed: Dec. 19, 2016

(65) Prior Publication Data

US 2017/0098345 A1 Apr. 6, 2017

Related U.S. Application Data

(63) Continuation of application No. 13/626,665, filed on Sep. 25, 2012, now Pat. No. 9,524,614.

(51) Int. Cl.
*G07F 17/32* (2006.01)

(52) U.S. Cl.
CPC ..... *G07F 17/3258* (2013.01); *G07F 17/3225* (2013.01)

(58) Field of Classification Search
CPC ..... G07F 17/32; G07F 17/3258
See application file for complete search history.

(56) References Cited

U.S. PATENT DOCUMENTS 4,743,022 A 5/1988 Wood
4,926,327 A 5/1990 Sidley
(Continued)

FOREIGN PATENT DOCUMENTS

WO WO 2007/090270 8/2007

OTHER PUBLICATIONS

"One Slot to Rule Them All . . . The Lord of the Rings," available at http://www.thegamingguide.com/slots/slot-articles/1220-one-slot-to-rule-them-all-the-lord-of-the-rings.html, printed May 31, 2012 (6 pages).

(Continued)

*Primary Examiner* — David L Lewis
*Assistant Examiner* — Shauna-Kay Hall
(74) *Attorney, Agent, or Firm* — Neal, Gerber & Eisenberg LLP

(57) ABSTRACT

Various embodiments of the present disclosure are directed to a gaming system and method for permanently increasing the average expected payback percentage of a game for a player. The gaming system is configured to operate a game associated with one or more designated point thresholds, each of which is associated with a quantity of points. The gaming system maintains a point balance for the player for the game. Upon an occurrence of a point accumulation event, the gaming system adds a quantity of points to the player's point balance for the game. When the player's point balance for the game reaches one of the designated point thresholds, the gaming system permanently modifies a feature of the game and/or adds a new feature to the game. In various embodiments, the modification to the feature and/or the new feature permanently increases the average expected payback percentage for the game for that player.

16 Claims, 9 Drawing Sheets

300

| Designated Point Threshold | Point Balance Needed to Reach the Designated Point Threshold | Modification Associated with the Designated Point Threshold | New Feature Associated with the Designated Point Threshold | Previous Average Expected Payback Percentage | New Average Expected Payback Percentage |
|---|---|---|---|---|---|
| 1 | 5,000 | None | New bonus game | 88.0% | 88.1% |
| 2 | 10,000 | Replace reel symbol with wild symbol | None | 88.1% | 88.3% |
| 3 | 20,000 | Replace reel symbol with bonus trigger symbol | None | 88.3% | 88.6% |
| 4 | 35,000 | None | New bonus game | 88.6% | 89.0% |
| 5 | 55,000 | Increase Jackpot award | None | 89.0% | 89.5% |
| 6 | 80,000 | None | New winning symbol combination | 89.5% | 90.1% |
| 7 | 110,000 | Increase lowest award | None | 90.1% | 90.8% |
| 8 | 145,000 | None | Activate new progressive award | 90.8% | 91.6% |
| 9 | 185,000 | None | Activate new respin feature | 91.6% | 92.5% |
| 10 | 230,000 | Replace a less favorable reel symbol with a more favorable reel symbol | None | 92.5% | 93.5% |

(56) References Cited

U.S. PATENT DOCUMENTS 4,991,848 A 2/1991 Greenwood et al.
5,019,973 A 5/1991 Wilcox et al.
5,078,405 A 1/1992 Jones et al.
5,123,649 A 6/1992 Tiberio
5,178,390 A 1/1993 Okada
5,248,142 A 9/1993 Breeding et al.
5,251,897 A 10/1993 Fulton et al.
5,280,909 A 1/1994 Tracy et al.
5,326,104 A 7/1994 Pease et al.
5,344,144 A 9/1994 Canon et al.
5,393,067 A 2/1995 Paulsen et al.
5,401,023 A 3/1995 Wood
5,411,257 A 5/1995 Fulton et al.
5,494,287 A 2/1996 Manz
5,511,781 A 4/1996 Wood et al.
5,542,669 A 8/1996 Charron et al.
5,564,700 A 10/1996 Celona et al.
5,564,701 A 10/1996 Dettor et al.
5,570,885 A 11/1996 Ornstein
5,584,485 A 12/1996 Jones et al.
5,586,766 A 12/1996 Forte et al.
5,611,535 A 3/1997 Tiberio
5,613,912 A 3/1997 Slater et al.
5,630,753 A 5/1997 Fuchs et al.
5,645,486 A 7/1997 Nagao et al.
5,655,961 A 8/1997 Acres et al.
5,702,304 A 12/1997 Acres et al.
5,719,431 A 2/1998 Werner
5,741,183 A 4/1998 Acres et al.
5,752,882 A 5/1998 Acres et al.
5,766,076 A 6/1998 Pease et al.
5,772,509 A 6/1998 Weiss et al.
5,779,547 A 7/1998 SoRelle et al.
5,779,549 A 7/1998 Walker et al.
5,788,574 A 8/1998 Ornstein et al.
5,806,855 A 9/1998 Cherry et al.
5,820,459 A 10/1998 Acres et al.
5,820,460 A 10/1998 Fulton et al.
5,830,063 A 11/1998 Byrne et al.
5,833,538 A 11/1998 Weiss
5,833,540 A 11/1998 Miodunski et al.
5,836,817 A 11/1998 Acres et al.
5,839,730 A 11/1998 Pike
5,851,010 A 12/1998 Feinberg et al.
5,851,147 A 12/1998 Stupak et al.
5,851,149 A 12/1998 Xidos et al.
5,855,515 A 1/1999 Pease et al.
5,876,283 A 3/1999 Parra et al.
5,876,284 A 3/1999 Acres et al.
5,885,158 A 3/1999 Torango et al.
5,890,963 A 4/1999 Yen
5,911,418 A 6/1999 Adams et al.
5,947,820 A 9/1999 Morro et al.
5,951,011 A 9/1999 Potter et al.
5,957,775 A 9/1999 Cherry
5,967,893 A 10/1999 Lawrence et al.
5,997,002 A 12/1999 Goldman et al.
6,001,016 A 12/1999 Walker et al.
6,004,207 A 12/1999 Wilson et al.
6,012,983 A 1/2000 Walker et al.
6,015,344 A 1/2000 Kelly et al.
6,039,648 A 3/2000 Guinn et al.
6,062,981 A 5/2000 Luciano
6,065,752 A 5/2000 Beltran et al.
6,068,552 A 5/2000 Walker et al.
6,077,162 A 6/2000 Weiss
6,077,163 A 6/2000 Walker et al.
6,089,980 A 7/2000 Gauselman et al.
6,110,041 A 8/2000 Walker et al.
6,113,492 A 9/2000 Walker et al.
6,135,884 A 10/2000 Hedrick et al.
6,142,872 A 11/2000 Walker et al.
6,155,925 A 12/2000 Giobbi et al.
6,159,097 A 12/2000 Gura et al.
6,162,122 A 12/2000 Acres et al.
6,186,894 B1 2/2001 Mayeroff
6,203,429 B1 3/2001 Demar et al.
6,206,782 B1 3/2001 Walker et al.
6,210,275 B1 4/2001 Olsen
6,213,877 B1 4/2001 Walker et al.
6,217,448 B1 4/2001 Olsen
6,224,482 B1 5/2001 Bennett
6,224,483 B1 5/2001 Mayeroff
6,227,969 B1 5/2001 Yoseloff
6,231,442 B1 5/2001 Mayeroff
6,231,445 B1 5/2001 Acres
6,238,288 B1 5/2001 Walker et al.
6,241,608 B1 6/2001 Torango
6,244,957 B1 6/2001 Walker et al.
6,244,958 B1 6/2001 Acres
6,254,483 B1 7/2001 Acres
6,257,981 B1 7/2001 Acres et al.
6,290,603 B1 9/2001 Luciano, Jr.
6,296,569 B1 10/2001 Congello, Jr.
6,311,976 B1 11/2001 Yoseloff et al.
6,312,332 B1 11/2001 Walker et al.
6,312,333 B1 11/2001 Acres
6,315,662 B1 * 11/2001 Jorasch ..... G07F 17/32
463/16
6,319,122 B1 11/2001 Packes, Jr. et al.
6,319,125 B1 11/2001 Acres
6,319,127 B1 11/2001 Walker et al.
6,336,862 B1 1/2002 Byrne
6,358,147 B1 3/2002 Jaffe et al.
6,364,768 B1 4/2002 Acres et al.
6,371,852 B1 4/2002 Acres
6,375,567 B1 4/2002 Acres
6,375,568 B1 4/2002 Roffman et al.
6,375,569 B1 4/2002 Acres
6,375,570 B1 4/2002 Poole
6,394,902 B1 5/2002 Glavich et al.
6,419,578 B1 7/2002 Moody et al.
6,425,823 B1 7/2002 Byrne
6,425,824 B1 7/2002 Baerlocher et al.
6,431,983 B2 8/2002 Acres
6,435,511 B1 8/2002 Vancura et al.
6,468,156 B1 10/2002 Hughs-Baird et al.
6,491,584 B2 12/2002 Graham et al.
6,517,073 B1 2/2003 Vancura
6,520,856 B1 2/2003 Walker et al.
6,565,434 B1 5/2003 Acres
6,569,013 B1 5/2003 Taylor
6,575,832 B1 6/2003 Manfredi et al.
6,589,115 B2 7/2003 Walker et al.
6,592,459 B2 7/2003 Parra et al.
6,592,460 B2 7/2003 Torango
6,607,195 B2 8/2003 Vancura
6,607,438 B2 8/2003 Baerlocher et al.
6,607,441 B1 8/2003 Acres
6,612,927 B1 9/2003 Slomiany et al.
6,620,046 B2 9/2003 Rowe
6,626,758 B1 9/2003 Parham et al.
6,632,141 B2 10/2003 Webb et al.
6,634,942 B2 10/2003 Walker et al.
6,648,753 B1 11/2003 Tracy et al.
6,652,378 B2 11/2003 Cannon et al.
6,656,047 B1 12/2003 Tarantino et al.
6,676,512 B2 1/2004 Fong et al.
6,692,354 B2 2/2004 Tracy et al.
6,695,700 B2 2/2004 Walker et al.
6,702,289 B1 3/2004 Feola
6,702,675 B2 3/2004 Poole et al.
6,709,330 B1 3/2004 Klein et al.
6,712,693 B1 3/2004 Hettinger
6,712,697 B2 3/2004 Acres
6,722,985 B2 4/2004 Criss-Puszkiewicz et al.
6,726,565 B2 4/2004 Hughs-Baird
6,746,016 B2 6/2004 Perrie et al.
6,749,510 B2 6/2004 Giobbi
6,758,748 B2 7/2004 Byrne
6,769,986 B2 8/2004 Vancura
6,786,824 B2 9/2004 Cannon
6,800,030 B2 10/2004 Acres
6,802,778 B1 10/2004 Lemay et al.

(56) References Cited

U.S. PATENT DOCUMENTS 6,814,664 B2 11/2004 Baerlocher et al.
6,832,958 B2 12/2004 Acres et al.
6,835,132 B2 12/2004 Bennett
6,837,788 B2 1/2005 Cannon
6,857,957 B2 2/2005 Marks et al.
6,857,959 B1 2/2005 Nguyen
6,869,076 B1 3/2005 Moore
6,869,361 B2 3/2005 Sharpless et al.
6,887,154 B1 5/2005 Luciano, Jr. et al.
6,910,964 B2 6/2005 Acres
6,969,317 B2 11/2005 Walker et al.
7,018,292 B2 3/2006 Tracy et al.
7,029,395 B1 4/2006 Baerlocher
7,037,192 B2 5/2006 Baerlocher et al.
7,040,982 B1 5/2006 Jarvis et al.
7,052,395 B2 5/2006 Glavich et al.
7,056,211 B2 6/2006 Taltavull et al.
7,056,215 B1 6/2006 Olive
7,077,746 B2 7/2006 Torango
7,112,138 B2 9/2006 Hedrick et al.
7,115,033 B1 10/2006 Timperley
7,140,964 B2 11/2006 Walker et al.
7,156,739 B2 1/2007 Walker et al.
7,192,344 B2 3/2007 Baerlocher
7,198,569 B2 4/2007 Wolf et al.
7,258,611 B2 8/2007 Bigelow, Jr. et al.
7,291,068 B2 11/2007 Bryant et al.
7,311,605 B2 12/2007 Moser
7,314,410 B2 1/2008 Baerlocher et al.
7,318,774 B2 1/2008 Bryant et al.
7,329,179 B2 2/2008 Baerlocher
7,338,370 B2 3/2008 Oles et al.
7,351,146 B2 4/2008 Kaminkow
7,357,714 B2 4/2008 Tessmer et al.
7,361,085 B2 4/2008 Packes, Jr. et al.
7,371,173 B2 5/2008 Gatto et al.
7,374,486 B2 5/2008 Baerlocher
7,384,334 B2 6/2008 Glavich et al.
7,384,337 B2 6/2008 Thomas
7,402,101 B2 7/2008 Casey
7,419,429 B2 9/2008 Taylor
7,427,233 B2 9/2008 Walker et al.
7,452,272 B2 11/2008 Walker et al.
7,465,227 B2 12/2008 Baerlocher
7,465,229 B2 12/2008 Shuster
7,470,185 B2 12/2008 Baerlocher
7,513,828 B2 4/2009 Nguyen et al.
7,563,167 B2 7/2009 Walker et al.
7,588,496 B2 9/2009 Van Asdale
7,611,411 B2 11/2009 Griswold et al.
7,617,151 B2 11/2009 Rowe
7,661,678 B2 2/2010 Snow
7,727,061 B2 6/2010 Taylor
7,740,534 B2 6/2010 Walker et al.
7,740,536 B2 6/2010 Pederson et al.
7,740,538 B2 6/2010 Nguyen et al.
7,749,081 B1 7/2010 Acres
7,758,429 B2 7/2010 Crivelli et al.
7,771,274 B2 8/2010 Walker et al.
7,789,755 B2 9/2010 Davis et al.
7,828,648 B2 11/2010 Jackson
7,846,018 B2 12/2010 Baerlocher
7,862,423 B2 1/2011 Walker et al.
7,883,403 B2 2/2011 Low et al.
7,927,212 B2 4/2011 Hedrick et al.
7,985,133 B2 7/2011 Baerlocher et al.
8,002,621 B2 8/2011 Mattice et al.
8,021,222 B2 9/2011 Walker et al.
8,070,597 B2 12/2011 Cuddy
8,177,627 B2 5/2012 Baerlocher
8,177,633 B2 5/2012 Baerlocher et al.
8,210,928 B2 7/2012 Walker et al.
8,216,062 B2 7/2012 Baerlocher et al.
8,231,454 B2 7/2012 Caputo
2001/0038178 A1 11/2001 Vancura
2001/0054794 A1 12/2001 Cole et al.
2001/0055990 A1 12/2001 Acres
2002/0058546 A2 5/2002 Acres
2002/0132660 A1 9/2002 Taylor
2002/0138594 A1 9/2002 Rowe
2002/0147040 A1 10/2002 Walker et al.
2002/0165023 A1 11/2002 Brosnan et al.
2002/0177483 A1 11/2002 Cannon
2002/0183105 A1 12/2002 Cannon et al.
2002/0193158 A1 12/2002 Weiss et al.
2003/0027625 A1 2/2003 Rowe
2003/0045350 A1 3/2003 Baerlocher et al.
2003/0060266 A1 3/2003 Baerlocher
2003/0060279 A1 3/2003 Torango
2003/0073488 A1 4/2003 Okita et al.
2003/0078101 A1 4/2003 Schneider et al.
2003/0090063 A1 5/2003 Jarvis et al.
2003/0092484 A1 5/2003 Schneider et al.
2003/0100360 A1* 5/2003 Manfredi ..... G07F 17/32
463/25
2003/0114217 A1 6/2003 Walker et al.
2003/0144053 A1 7/2003 Michaelson
2003/0144965 A1 7/2003 Prasad et al.
2003/0186733 A1 10/2003 Wolf et al.
2003/0207713 A1 11/2003 Taylor
2003/0211880 A1 11/2003 Locke
2003/0216170 A1 11/2003 Walker et al.
2003/0222402 A1 12/2003 Olive
2003/0228904 A1 12/2003 Acres et al.
2003/0232647 A1 12/2003 Moser
2004/0009811 A1 1/2004 Torango
2004/0023713 A1 2/2004 Wolf et al.
2004/0038724 A1 2/2004 Asdale
2004/0063492 A1 4/2004 Baerlocher et al.
2004/0072615 A1 4/2004 Maya et al.
2004/0102238 A1 5/2004 Taylor
2004/0147308 A1 7/2004 Walker et al.
2004/0166931 A1 8/2004 Criss-Puszkiewicz et al.
2004/0204218 A1 10/2004 Hughs-Baird
2004/0242297 A1 12/2004 Walker et al.
2004/0242313 A1 12/2004 Munoz
2004/0248648 A1 12/2004 Rothschild et al.
2005/0009597 A1 1/2005 Daly
2005/0020342 A1 1/2005 Palmer et al.
2005/0032573 A1 2/2005 Acres et al.
2005/0054429 A1 3/2005 Baerlocher et al.
2005/0060050 A1 3/2005 Baerlocher
2005/0071023 A1 3/2005 Gilliland et al.
2005/0085294 A1 4/2005 Walker et al.
2005/0085295 A1 4/2005 Walker et al.
2005/0096121 A1 5/2005 Gilliland et al.
2005/0096123 A1 5/2005 Cregan et al.
2005/0119047 A1 6/2005 Olive
2005/0143166 A1 6/2005 Walker et al.
2005/0143168 A1 6/2005 Torango
2005/0153767 A1 7/2005 Gauselmann
2005/0153768 A1 7/2005 Paulsen
2005/0153773 A1 7/2005 Nguyen et al.
2005/0176488 A1 8/2005 Olive
2005/0202863 A1 9/2005 Macaulay
2005/0208992 A1 9/2005 Randall
2005/0209004 A1 9/2005 Torango
2005/0239542 A1 10/2005 Olsen
2005/0239546 A1 10/2005 Hedrick et al.
2005/0261059 A1 11/2005 Nguyen et al.
2005/0282625 A1 12/2005 Nicely
2005/0282635 A1 12/2005 Aoki
2006/0003829 A1 1/2006 Thomas
2006/0025193 A1 2/2006 Gail et al.
2006/0035701 A1 2/2006 Walker et al.
2006/0035705 A1 2/2006 Jordan et al.
2006/0040723 A1 2/2006 Baerlocher et al.
2006/0040728 A1 2/2006 Fuller
2006/0040732 A1 2/2006 Baerlocher et al.
2006/0040733 A1 2/2006 Baerlocher et al.
2006/0040734 A1 2/2006 Baerlocher et al.
2006/0040736 A1 2/2006 Baerlocher et al.
2006/0046816 A1 3/2006 Walker et al.
2006/0046832 A1 3/2006 Isogai et al.

(56) References Cited

U.S. PATENT DOCUMENTS

2006/0046835 A1 3/2006 Walker et al.
2006/0058095 A1 3/2006 Berman et al.
2006/0063580 A1 3/2006 Nguyen et al.
2006/0068883 A1 3/2006 Randall et al.
2006/0068903 A1 3/2006 Walker et al.
2006/0084496 A1* 4/2006 Jaffe ..... G07F 17/3239 463/20
2006/0089195 A1 4/2006 Walker et al.
2006/0142077 A1 6/2006 Miles et al.
2006/0172794 A1 8/2006 Walker et al.
2006/0202415 A1 9/2006 Taylor
2006/0211489 A1 9/2006 Walker et al.
2006/0217187 A1 9/2006 Walker et al.
2006/0217188 A1 9/2006 Walker et al.
2006/0247030 A1 11/2006 Walker et al.
2006/0247031 A1 11/2006 Walker et al.
2006/0248025 A1 11/2006 Walker et al.
2006/0252512 A1 11/2006 Walker et al.
2006/0252515 A1 11/2006 Walker et al.
2006/0281541 A1 12/2006 Nguyen et al.
2006/0287071 A1 12/2006 Walker et al.
2006/0287072 A1 12/2006 Walker et al.
2007/0004508 A1 1/2007 Walker et al.
2007/0021182 A1 1/2007 Gauselmann
2007/0054726 A1 3/2007 Muir et al.
2007/0060246 A1 3/2007 Baerlocher et al.
2007/0060252 A1 3/2007 Taylor
2007/0087804 A1 4/2007 Knowles et al.
2007/0087818 A1 4/2007 Walker et al.
2007/0105619 A1 5/2007 Kniesteadt et al.
2007/0117612 A1 5/2007 Walker et al.
2007/0117616 A1 5/2007 Bartholomew
2007/0135207 A1 6/2007 Tarantino
2007/0178970 A1 8/2007 LeMay et al.
2007/0184894 A1 8/2007 Baerlocher
2007/0191102 A1 8/2007 Coliz et al.
2007/0213123 A1 9/2007 Walker et al.
2007/0270213 A1 11/2007 Nguyen et al.
2007/0287532 A1 12/2007 Jackson
2007/0293293 A1 12/2007 Baerlocher et al.
2007/0298857 A1 12/2007 Schlottmann et al.
2008/0020847 A1 1/2008 Kniesteadt et al.
2008/0032787 A1 2/2008 Low et al.
2008/0045344 A1 2/2008 Schlottmann et al.
2008/0064489 A1 3/2008 Seelig et al.
2008/0064491 A1 3/2008 Taylor
2008/0064502 A1 3/2008 Schlottmann et al.
2008/0070676 A1 3/2008 Baerlocher et al.
2008/0070677 A1 3/2008 Baerlocher et al.
2008/0070678 A1 3/2008 Baerlocher et al.
2008/0070680 A1 3/2008 Baerlocher et al.
2008/0070693 A1 3/2008 Schlottmann et al.
2008/0070695 A1 3/2008 Baerlocher et al.
2008/0076496 A1 3/2008 Baerlocher et al.
2008/0076503 A1 3/2008 Mattice et al.
2008/0076527 A1 3/2008 Low et al.
2008/0076531 A1 3/2008 Baerlocher et al.
2008/0076532 A1 3/2008 Graham et al.
2008/0076534 A1 3/2008 Iddings et al.
2008/0076542 A1 3/2008 Iddings et al.
2008/0076576 A1 3/2008 Graham et al.
2008/0081689 A1 4/2008 Seelig et al.
2008/0081690 A1 4/2008 Baerlocher et al.
2008/0081691 A1 4/2008 Baerlocher et al.
2008/0085771 A1 4/2008 Iddings et al.
2008/0085772 A1 4/2008 Iddings et al.
2008/0102916 A1 5/2008 Kovacs et al.
2008/0102934 A1 5/2008 Tan
2008/0102935 A1 5/2008 Finnimore
2008/0108423 A1 5/2008 Benbrahim et al.
2008/0113759 A1 5/2008 Baerlocher
2008/0113771 A1 5/2008 Baerlocher et al.
2008/0113779 A1 5/2008 Cregan
2008/0113810 A1 5/2008 Kubota et al.
2008/0139274 A1 6/2008 Baerlocher
2008/0139290 A1 6/2008 Kniesteadt et al.
2008/0153564 A1 6/2008 Baerlocher et al.
2008/0167105 A1 7/2008 Kaminkow
2008/0176645 A1 7/2008 Griswold et al.
2008/0182650 A1 7/2008 Randall et al.
2008/0182655 A1* 7/2008 DeWaal ..... G07F 17/32 463/25
2008/0194316 A1 8/2008 Baerlocher
2008/0214280 A1 9/2008 Baerlocher
2008/0214292 A1 9/2008 Bryant et al.
2008/0220851 A1 9/2008 Glavich et al.
2008/0318668 A1 12/2008 Ching et al.
2009/0042652 A1 2/2009 Baerlocher et al.
2009/0088239 A1 4/2009 Iddings et al.
2009/0117989 A1 5/2009 Arezina et al.
2009/0124316 A1 5/2009 Baerlocher et al.
2009/0124384 A1 5/2009 Smith et al.
2009/0181758 A1 7/2009 Loose et al.
2010/0041468 A1 2/2010 Baerlocher et al.
2010/0081497 A1 4/2010 Wolf et al.
2010/0120495 A1 5/2010 Frank et al.
2010/0120506 A1 5/2010 Davis et al.
2010/0120514 A1 5/2010 Caputo
2010/0124971 A1 5/2010 Baerlocher et al.
2010/0144415 A1 6/2010 Wolf et al.
2010/0160031 A1 6/2010 Gilliland et al.
2010/0210338 A1 8/2010 Taylor
2010/0227678 A1 9/2010 Konishi et al.
2010/0267441 A1 10/2010 Baerlocher
2011/0034236 A1 2/2011 Jackson
2011/0039610 A1 2/2011 Baerlocher et al.
2011/0053676 A1 3/2011 Wolf et al.
2011/0092274 A1 4/2011 Low et al.
2011/0105216 A1 5/2011 Cohen et al.
2011/0111826 A1 5/2011 Baerlocher et al.
2011/0118004 A1 5/2011 Kelly et al.
2011/0118010 A1 5/2011 Brune
2011/0212764 A1 9/2011 Baerlocher et al.
2012/0088573 A1 4/2012 Hedrick et al.

OTHER PUBLICATIONS

"Thunderstruck II Slots Online," available at http://thunderstruckii.com/, printed Sep. 26, 2012 (3 pages).

* cited by examiner

FIG. 2

200

| Designated Point Threshold | Point Balance Needed to Reach the Designated Point Threshold | Modification Associated with the Designated Point Threshold | New Feature Associated with the Designated Point Threshold | Previous Average Expected Payback Percentage | New Average Expected Payback Percentage |
|---|---|---|---|---|---|
| 1 | 5,000 | None | New bonus game | 90.0% | 90.1% |
| 2 | 10,000 | Replace reel symbol with wild symbol | None | 90.1% | 90.2% |
| 3 | 15,000 | Replace reel symbol with bonus trigger symbol | None | 90.2% | 90.3% |
| 4 | 20,000 | None | New bonus game | 90.3% | 90.4% |
| 5 | 25,000 | Increase Jackpot award | None | 90.4% | 90.5% |
| 6 | 30,000 | None | New winning symbol combination | 90.5% | 90.6% |
| 7 | 35,000 | Increase lowest award | None | 90.6% | 90.7% |
| 8 | 40,000 | None | Activate new progressive award | 90.7% | 90.8% |
| 9 | 45,000 | None | Activate new respin feature | 90.8% | 90.9% |
| 10 | 50,000 | Replace a less favorable reel symbol with a more favorable reel symbol | None | 90.9% | 91.0% |

FIG. 3

300

| Designated Point Threshold | Point Balance Needed to Reach the Designated Point Threshold | Modification Associated with the Designated Point Threshold | New Feature Associated with the Designated Point Threshold | Previous Average Expected Payback Percentage | New Average Expected Payback Percentage |
|---|---|---|---|---|---|
| 1 | 5,000 | None | New bonus game | 88.0% | 88.1% |
| 2 | 10,000 | Replace reel symbol with wild symbol | None | 88.1% | 88.3% |
| 3 | 20,000 | Replace reel symbol with bonus trigger symbol | None | 88.3% | 88.6% |
| 4 | 35,000 | None | New bonus game | 88.6% | 89.0% |
| 5 | 55,000 | Increase Jackpot award | None | 89.0% | 89.5% |
| 6 | 80,000 | None | New winning symbol combination | 89.5% | 90.1% |
| 7 | 110,000 | Increase lowest award | None | 90.1% | 90.8% |
| 8 | 145,000 | None | Activate new progressive award | 90.8% | 91.6% |
| 9 | 185,000 | None | Activate new respin feature | 91.6% | 92.5% |
| 10 | 230,000 | Replace a less favorable reel symbol with a more favorable reel symbol | None | 92.5% | 93.5% |

FIG. 4

400

| Designated Point Threshold | Point Balance Needed to Reach the Designated Point Threshold | Modification Associated with the Designated Point Threshold | New Feature Associated with the Designated Point Threshold | Previous Average Expected Payback Percentage | New Average Expected Payback Percentage |
|---|---|---|---|---|---|
| 1 | 10,000 | None | New bonus game | 91.0% | 91.2% |
| 2 | 20,000 | Replace reel symbol with wild symbol | None | 91.2% | 91.4% |
| 3 | 40,000 | Replace reel symbol with bonus trigger symbol | None | 91.4% | 91.6% |
| 4 | 70,000 | None | New bonus game | 91.6% | 91.8% |
| 5 | 110,000 | Increase Jackpot award | None | 91.8% | 92.0% |
| 6 | 120,000 | Modify game music | None | 92.0% | 92.0% |
| 7 | 130,000 | None | Add new background option | 92.0% | 92.0% |
| 8 | 140,000 | Modify art used for the game | None | 92.0% | 92.0% |
| 9 | 150,000 | Modify screen brightness | None | 92.0% | 92.0% |
| 10 | 160,000 | None | Add player customization feature | 92.0% | 92.0% |

FIG. 5

500

| Designated Point Threshold | Point Balance Needed to Reach the Designated Point Threshold | Modification Associated with the Designated Point Threshold | New Feature Associated with the Designated Point Threshold | Previous Average Expected Payback Percentage | New Average Expected Payback Percentage |
|---|---|---|---|---|---|
| 1 | 7,500 | None | New bonus game | 88.0% | 88.2% |
| 2 | 20,000 | Replace reel symbol with wild symbol | None | 88.2% | 90.0% |
| 3 | 25,000 | Modify game music | None | 90.0% | 90.0% |
| 4 | 42,500 | None | New bonus game | 90.0% | 90.4% |
| 5 | 100,000 | Increase Jackpot award | None | 90.4% | 91.4% |
| 6 | 102,500 | None | Add new background option | 91.4% | 91.4% |
| 7 | 165,000 | Replace reel symbol with bonus trigger symbol | None | 91.4% | 92.0% |
| 8 | 180,000 | Modify art used for the game | None | 92.0% | 92.0% |
| 9 | 195,000 | Modify screen brightness | None | 92.0% | 92.0% |
| 10 | 200,000 | None | Add player customization feature | 92.0% | 92.0% |

GAMING SYSTEM AND METHOD FOR PERMANENTLY INCREASING THE AVERAGE EXPECTED PAYBACK PERCENTAGE OF A GAME FOR A PLAYER

PRIORITY CLAIM

This patent application is a continuation of and claims priority to and the benefit of U.S. patent application Ser. No. 13/626,665, which was filed on Sep. 25, 2012, the entire contents of which are incorporated herein by reference.

COPYRIGHT NOTICE

A portion of the disclosure of this patent document contains material that is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming machines that provide players awards in primary or base games are well known. These gaming machines generally require a player to place a wager to activate a play of the primary game. For many of these gaming machines, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in higher awards being provided when they do occur. Winning symbols or winning symbol combinations are typically displayed to the player via a paytable. The paytable defines an average expected payback percentage for the primary game.

Bonus or secondary games are also known in gaming machines. Such gaming machines usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming machine may initiate or trigger a bonus game when a bonus symbol occurs on the payline on the third reel of a three reel slot machine. The gaming machine generally indicates when a bonus game is initiated or triggered through one or more visual and/or audio output devices, such as the reels, lights, speakers, display screens, etc. Part of the enjoyment and excitement of playing certain gaming machines is the initiation or triggering of a bonus game, even before the player knows an amount of a bonus award won via the bonus game.

Most gaming machines are designed to pay back, on average, a certain percentage of the amount of money wagered by players over a large number of plays of the game. The average percentage of money wagered that is paid back to the player is typically called the average expected payback percentage, the average expected payback, or the average expected return. The more games that are played on a given machine, the more likely that the actual payback percentage will approach the average expected payback percentage. The average expected payback percentage provided by a gaming machine is determined by the paytable of the game of that gaming machine. For a slot game, a paytable determines which awards will be provided to a player if certain winning symbols or winning symbol combinations appear on an activated or wagered on payline.

Most gaming machines are also designed to hold, on average, a certain percentage of the amount of money wagered by players over a large number of plays of the game. The average percentage of money wagered that is held by the gaming machine is typically called the average expected hold or the average expected hold percentage. The more games that are played on a given machine, the more likely that the actual hold will approach the average expected hold percentage. The average expected hold percentage and the average expected payback percentage constitute, on average, 100% of the money wagered on the gaming machine. Gaming machines with a higher average expected payback percentage have a lower average expected hold percentage, and vice versa.

Most games played at existing gaming machines have paytables that include predetermined winning symbol combinations or events. As a result, such games also have paytables with predetermined, static average expected payback percentages. In such existing gaming machines, the amounts of the wagers made on the primary games by the player may vary while the average expected payback percentage (or the average expected hold percentage) for such primary games remains constant.

Certain known or proposed gaming machines enable players to, for a play of a game, purchase a better or enhanced paytable for that play of the game or purchase a chance to receive a better or enhanced paytable for that play of the game. The better or enhanced paytable typically has an average expected payback percentage that is higher than an average expected payback percentage of a default or initial paytable of the game. The better or enhanced paytable is, however, active for a limited duration, such as for a single play of the game or for a designated quantity of at least two plays of the game. In other words, the better or enhanced paytable is not permanent for all subsequent plays of the game. Further, for a player to obtain the better or enhanced paytable, the player must pay a fee or place an additional wager.

Gaming establishment or casino loyalty programs are also well known. A casino loyalty program works in conjunction with a player tracking system to offer incentives to players in exchange for the player's loyally to and play history at the gaming establishment. Such loyalty incentives are often provided and funded by the gaming establishment's marketing department. These marketing department promotions are not accounted for in determining the overall paytable for the gaming machines. One known way to provide loyalty incentives to players is by offering promotional credits (delivered as either direct mail offers or as a result of a loyally bonus) to be utilized in one or more wagering games. Such promotional credits are often offered as a one-time event, such as for a player signing up for a player tracking card. Another known way to provide loyally incentives to players is to offer free promotional game plays delivered as either direct mail or email offers or as a result of a loyalty bonus.

There is a continuing need to provide a gaming system configured to reward a loyal player of a game in response to the player simply playing the game and, more specifically, to provide a gaming system configured to permanently increase the average expected payback percentage of a game as a reward in response to a player simply playing that game.

SUMMARY

Various embodiments of the present disclosure are directed to a gaming system and method for permanently increasing the average expected payback percentage of a game for a player. In certain embodiments, the gaming system of the present disclosure is configured to operate a game associated with one or more designated point thresholds or levels, each of which is associated with a different quantity of points and one or more feature modifications and/or new features. The gaming system maintains a point balance for a player for the game. The point balance includes any points accumulated for the player in association with plays of the game (as described below), and is persistently stored by the gaming system across the gaming sessions of the player.

More specifically, upon an occurrence of one or more of a plurality of different point accumulation events associated with the game, the gaming system accumulates a quantity of points for the player for the game. The gaming system does so by adding that quantity of points to the point balance of the player for the game. For each of the designated point thresholds, when the player's point balance for the game reaches that designated point threshold (i.e., equals or exceeds the quantity of points associated with that designated point threshold), the gaming system employs the feature modification(s) associated with that designated point threshold to modify one or more features of the game and/or adds the new feature(s) associated with that designated point threshold to the game such that, for each subsequent play of the game by the player, the gaming system provides the game having the modified feature(s) and/or the new feature(s). In other words, for each of the designated point thresholds, once that designated point threshold is reached in these embodiments, the feature modification(s) and/or the new feature(s) associated with that designated point threshold are permanently employed in and/or added to the game for all subsequent plays of the game by the player.

It should be appreciated that any modified features are enhanced, higher level, or better features as compared to their pre-modified states. Similarly, it should be appreciated that any new features are enhanced, higher level, or better features as compared to at least one other feature of the game. In various embodiments, one or more of the feature modifications and/or the new features associated with the designated point thresholds permanently increase the average expected payback percentage for the game for that player. Thus, in these embodiments, the gaming system of the present disclosure enables a player to permanently increase the average expected payback percentage of a game simply by playing the game and accumulating points.

Additional features and advantages are described in, and will be apparent from, the following Detailed Description and the Figures.

BRIEF DESCRIPTION OF THE FIGURES

FIG. 2 illustrates an example set of designated point thresholds associated with a game operated by an embodiment of the gaming system of the present disclosure.

FIG. 3 illustrates another example set of designated point thresholds associated with a game operated by another embodiment of the gaming system of the present disclosure.

FIG. 4 illustrates another example set of designated point thresholds associated with a game operated by another embodiment of the gaming system of the present disclosure.

FIG. 5 illustrates another example set of designated point thresholds associated with a game operated by another embodiment of the gaming system of the present disclosure.

DETAILED DESCRIPTION

Figure 1:
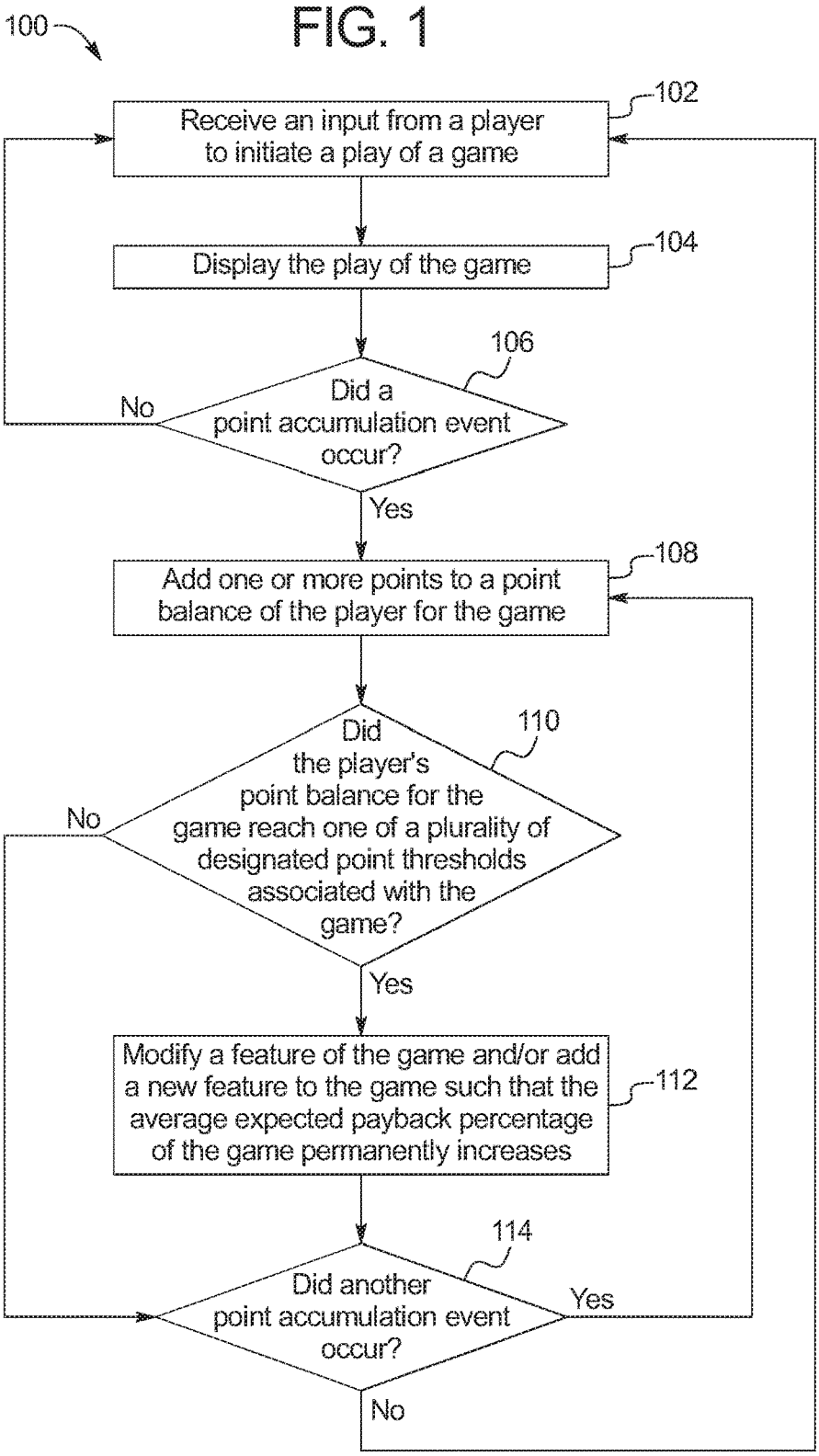
FIG. 1 is a flowchart illustrating an example method of operating an embodiment of the gaming system of the present disclosure configured to permanently increase the average expected payback percentage of a game for a player.

Permanently Increasing the Average Expected Payback Percentage of a Game for a Player Various embodiments of the present disclosure are directed to a gaming system and method for permanently increasing the average expected payback percentage of a game for a player. In certain embodiments, the gaming system of the present disclosure is configured to operate a game associated with one or more designated point thresholds or levels, each of which is associated with a different quantity of points and one or more feature modifications and/or new features. The gaming system maintains a point balance for a player for the game. The point balance includes any points accumulated for the player in association with plays of the game (as described below), and is persistently stored by the gaming system across the gaming sessions of the player.

In certain embodiments, each of the designated point thresholds is associated with one or more feature modifications and/or new features. In other embodiments, the gaming system includes a bank or pool of feature modifications and/or new features. In these embodiments, when the player's point balance reaches one of the designated point thresholds (as described below), the gaming system selects one or more of the feature modifications and/or new features from the bank to employ. In further embodiments, the gaming system includes a plurality of groups of feature modifications and/or new features. In such embodiments, when the player's point balance reaches one of the designated point thresholds (as described below), the gaming system selects (such as randomly or in a predetermined manner) one or more of the feature modifications and/or new features from one or more of the groups to employ.

More specifically, upon an occurrence of one or more of a plurality of different point accumulation events associated with the game, the gaming system accumulates a quantity of points for the player for the game. The gaming system does so by adding that quantity of points to the point balance of the player for the game. For each of the designated point thresholds, when the player's point balance for the game reaches that designated point threshold (i.e., equals or exceeds the quantity of points associated with that designated point threshold), the gaming system employs the feature modification(s) associated with that designated point threshold to modify one or more features of the game and/or adds the new feature(s) associated with that designated point threshold to the game such that, for each subsequent play of the game by the player, the gaming system provides the game having the modified feature(s) and/or the new feature(s). In other words, for each of the designated point thresholds, once that designated point threshold is reached in these embodiments, the feature modification(s) and/or the new feature(s) associated with that designated point threshold are permanently employed in and/or added to the game for all subsequent plays of the game by the player.

Put differently, for each of the designated point thresholds, once that designated point threshold is reached in these embodiments, the gaming system employs the feature modification(s) associated with that designated point threshold to modify one or more feature(s) of the game and/or adds the new feature(s) associated with that designated point threshold to the game so that such modifications and such new features are present play after play, gaming session after gaming session, month after month, and year after year.

It should be appreciated that any modified features are enhanced, higher level, or better features as compared to their pre-modified states. Similarly, it should be appreciated that any new features are enhanced, higher level, or better features as compared to at least one other feature of the game. In various embodiments, one or more of the feature modifications and/or the new features associated with the designated point thresholds permanently increase the average expected payback percentage for the game for that player. Thus, in these embodiments, the gaming system of the present disclosure enables a player to permanently increase the average expected payback percentage of a game simply by playing the game and accumulating points.

It should be appreciated that, in various embodiments, the gaming system requires the player to identify himself or herself (such as via a player identification card, a username and password combination, and the like) before the gaming system provides the player any points for game play.

While the embodiments described below are directed to a primary or base wagering game, it should be appreciated that the present disclosure may additionally or alternatively be employed in association with a secondary or bonus game. Moreover, while the player's credit balance, the player's wager, and any awards are displayed as an amount of monetary credits or currency in the embodiments described below, one or more of such player's credit balance, such player's wager, and any awards provided to such player may be for non-monetary credits, promotional credits, and/or player tracking points or credits.

In various embodiments, the gaming system accumulates a steady stream of points for the player for the game in response to the player simply playing the game. That is, the present disclosure contemplates that the player does not need to be lucky (or extraordinarily lucky) to accumulate points such that the player's point balance for the game reaches one or more of the designated point thresholds associated with the game, and thus cause the gaming system to employ the (permanent) enhanced, higher level, or better modified and/or new features for the game. It should be appreciated that, in certain embodiments, the gaming system is configured to enable every player to accumulate enough points to reach one or more of the designated point thresholds associated with the game by simply playing the game for an extended period of time. The gaming system of the present disclosure is, therefore, configured to reward loyal players, not just lucky players.

In certain embodiments, for a given player and a given game, the gaming system maintains separate point balances for the player for the game in association with each electronic gaming machine (EGM) (described in detail below) on which the player plays the game. For instance, the gaming system maintains a first point balance for the player for all instances of the game played on a first EGM and a second separate point balance for the player for all instances of the game played on a second different EGM. Thus, in these embodiments, the features (and, in certain instances, the average expected payback percentage) of the game may differ for the player depending on at which EGM the player plays the game.

In other embodiments, for a given player and a given game, the gaming system maintains separate point balances for the player for the game in association with each gaming establishment at which the player plays the game. For example, the gaming system maintains a first point balance for the player for the game for all instances of the game played at a first gaming establishment and a second separate point balance for the player for the game for all instances of the game played at a second different gaming establishment. Thus, in these embodiments, the features of the game may differ for the player depending on at which gaming establishment the player plays the game. However, in these embodiments, the features (and, in certain instances, the average expected payback percentage) of the game do not differ within each respective gaming establishment (i.e., do not differ among different EGMs in a given gaming establishment that are configured to operate the game).

In further embodiments, for a given player and a given game, the gaming system maintains separate point balances for the player for the game in association with each platform on which the player plays the game. For instance, the gaming system maintains a first point balance for the player for the game for all instances of the game played at a land-based casino, a second separate point balance for the player for the game for all instances of the game played at an online casino, and a third separate point balance for the player for the game for all instances of the game played at a casino accessible via a mobile device. Thus, in these embodiments, the features (and, in certain instances, the average expected payback percentage) of the game may differ for the player depending on which platform the player uses to play the game. However, in these embodiments, the features (and, in certain instances, the average expected payback percentage) of the game do not differ within each respective platform.

In other embodiments, for a given player and a given game, the gaming system maintains separate point balances for the player for the game in association with each denomination EGM at which the player plays the game. For instance, the gaming system maintains a first point balance for the player for the game for all instances of the game played at a $0.25 denomination EGM and a second separate point balance for the player for the game for all instances of the game played at a $1 denomination EGM. Thus, in these embodiments, the features (and, in certain instances, the average expected payback percentage) of the game may differ for the player depending on at which denomination EGM the player plays the game. However, in these embodiments, the features (and, in certain instances, the average expected payback percentage) of the game do not differ among EGMs of the same denomination.

In further embodiments, for a given player and a given game, the gaming system maintains separate point balances for the player for the game in association with each currency the player uses to play the game. For example, the gaming system maintains a first point balance for the player for the game for all instances of the game played using U.S. dollars and a second separate point balance for the player for the game for all instances of the game played using Euros. Thus, in these embodiments, the features (and, in certain instances, the average expected payback percentage) of the game may differ for the player depending on which currency the player uses to play the game.

In other embodiments, for a given player and a given game, the gaming system maintains separate point balances for the player for the game in association with each wager amount the player places to play the game. For example, the gaming system maintains a first point balance for the player for the game for all instances of the game played for a minimum wager amount and a second separate point balance for the player for the game for all instances of the game played using a maximum wager amount. Thus, in these embodiments, the features (and, in certain instances, the average expected payback percentage) of the game may differ for the player depending on how much the player wagers on a play of the game. In one embodiment, initial wagers count toward point balance increases, while in another embodiment both initial and virtual wagers (placed on free games) count toward point balance increases.

In further embodiments, for a given player and a given game, the gaming system maintains separate point balances for the player for the game in association with each jurisdiction in which the player plays the game. For example, the gaming system maintains a first point balance for the player for the game for all instances of the game played within a first jurisdiction and a second separate point balance for the player for the game for all instances of the game played within a second different jurisdiction. Thus, in these embodiments, the features (and, in certain embodiments, the average expected payback percentage) of the game may differ for the player depending upon the jurisdiction within which the player plays the game.

In various embodiments, for a given player and a given game, the gaming system maintains a single point balance for the player for the game. That is, in these embodiments, the gaming system accumulates all points provided to the player in association with the game to the single point balance regardless or independent of the EGM at which the game was played, the gaming establishment at which the game was played, the platform on which the game was played, the denomination of the EGM at which the game was played, the type of currency used to play the game, the wager amount placed on the game, or the jurisdiction within which the game was played. In one example, a player may accumulate points playing a mobile version of the game on the player's smart phone (or any other suitable device), continue accumulating points while playing an online version of the game at an online casino, and continue accumulating points while playing a version of the game at a land-based casino.

In one such embodiment, the features (and, in certain instances, the average expected payback percentage) of the game do not differ across EGMs, across gaming establishments, across platforms, across denominations, across types of currency, across wager amounts, or across jurisdictions. For example, when the player's point balance reaches a designated point threshold, a wild symbol is added to the reels used in the mobile, online, and land-based versions of the game. In another such embodiment, the features of the game (and, in certain instances, the average expected payback percentage) of the game differ across EGMs, across gaming establishments, across platforms, across denominations, across types of currency, across wager amounts, and/or across jurisdictions. For example, when the player's point balance reaches a designated point threshold, a wild symbol is added to the reels used in the mobile version of the game, a bonus symbol is added to the reels in the online version of the game, and a jackpot symbol is added to the reels in the land-based versions of the game.

In another embodiment, for a given player and a given game, the gaming system maintains a point balance for the player for the game associated with a plurality of, but less than all of, the platforms on which the game may be played. For instance, the gaming system maintains one point balance including points accumulated at land-based casinos and another point balance including points accumulated at online and mobile casinos.

In another embodiment, the gaming system maintains point balances associated with two different types of points that are accumulated by the player. For instance, the gaming system accumulates a first type of points in a first point balance based on the player's coin-in and a second type of points in a second point balance based on bonus game outcomes. In this example, the first type of points are associated with primary game feature upgrades (when designated point thresholds are reached) and the second type of points are associated with bonus game feature upgrades (when designated point thresholds are reached).

In one embodiment, the gaming system is configured to provide different rates of point accumulation with respect to differing wager amounts. That is, in this embodiment, the gaming system provides a player a relatively higher rate of point accumulation when the player places a wager having a relatively high amount, and the gaming system provides the player a relatively lower rate of point accumulation when the player places a wager having a relatively low amount. For instance, the gaming system provides a player who places the maximum wager with a higher rate of point accumulation than if the player had placed the minimum wager.

In another embodiment, the gaming system is configured to provide different rates of point accumulation with respect to differing denomination EGMs configured to operate a same game. That is, in this embodiment, the gaming system provides a player a relatively higher rate of point accumulation when the player plays the game at a relatively high denomination EGM, and the gaming system provides a relatively lower rate of point accumulation when the player plays the game at a relatively low denomination EGM. For instance, the gaming system provides a player who plays the game at a $1 denomination EGM with a higher rate of point accumulation than if the player had played the game at a $0.25 denomination EGM.

In another embodiment, the gaming system is configured to provide different rates of point accumulation with respect to differing platforms configured to operate a same game or variations of the game. That is, in this embodiment, the gaming system provides a player a relatively higher rate of point accumulation when the player plays the game via a first platform (such as an online platform), and the gaming system provides the player a relatively lower rate of point accumulation when the player plays the game via a second different platform (such as a land-based EGM).

In other embodiments, the gaming system does not provide different rates of point accumulation with respect to differing wager amounts, differing denomination EGMs, or different platforms. Rather, in these embodiments, the gaming system provides a same rate of point accumulation regardless of the wager amount, denomination of the EGM, or platform on which the game is being played.

It should be appreciated that the present disclosure contemplates accumulating points for a player and modifying a feature(s) and/or adding a new feature(s) when a designated point threshold is reached for a single game or for multiple games. In various embodiments in which the gaming system accumulates points for a plurality of different games, the gaming system maintains a separate point balance for the player for each of the different games that the player plays. It should be appreciated that the gaming system is configured to track, for each game for the player, the number of points accumulated by the player for that game. Thus, the player will likely have different point balances (i.e., different quantities of accumulated points) for each of the plurality of different games that the player plays. That is, in these embodiments, each game is associated with a separate set of designated point thresholds and a separate point balance of the player.

In other embodiments in which the gaming system accumulates points for a plurality of different games, the gaming system maintains a single, collective point balance for the player for all of the different games that the player plays. In one such embodiment, all games are associated with a single, collective set of designated point thresholds, while in another such embodiment, each game is associated with a separate set of designated point thresholds. In further embodiments in which the gaming system accumulates points for a plurality of different games, the gaming system maintains separate collective point balances for the player for different groups of games. In one such embodiment, for each group, all games of that group are associated with a single, collective set of designated point thresholds while in another such embodiment, each game of that group is associated with a separate set of designated point thresholds. In one embodiment, the gaming system enables the player to select which games to include in the group or groups.

As noted above, the game is associated with one or more point accumulation events. When one of the point accumulation events occurs, the gaming system accumulates a quantity points for the player for the game (such as by adding the quantity of points to the player's point balance for the game). It should be appreciated that any suitable event may be a point accumulation event. For example, in various embodiments, a point accumulation event occurs when one or more of: (1) a winning outcome is obtained in the game; (2) a losing outcome is obtained in the game; (3) a winning outcome is obtained in a bonus game; (4) a losing outcome is obtained in a bonus game; (5) a jackpot award, progressive award, or other designated award is won in the game; (6) a jackpot award, progressive award, or other designated award is won in a bonus game; (7) certain symbols or symbol combinations are obtained in the game; (8) certain symbols or symbol combinations are obtained in a bonus game; (9) when the game is a card game, certain combinations of cards are obtained in the game; (10) when the game is a keno game, certain symbols or combinations of symbols are selected by the player and/or by the gaming system; (11) when the game is a keno game, a designated quantity of matches is obtained; (12) when the game is a blackjack game, the player's hand beats the dealer's hand by at least a designated amount; (13) when the game is a blackjack game, the player's hand loses to the dealer's hand by at least a designated amount; (14) certain board spots are landed on in a board bonus game; (15) the board is lapped in a board bonus game; (16) a certain number of symbols are collected in the game; (17) a certain number of symbols are collected in a bonus game; (18) a certain number of symbols are collected in the game and a bonus game; (19) a play of the game is initiated (such as the initiation of a spin of a plurality of reels); (20) a play of a bonus game is initiated; (21) a wager is placed on the game; (22) a wager of at least a designated amount is placed on the game; (23) a side wager is placed on the game; (24) currency or credits are deposited to fund the gaming system; (26) a total quantity of plays of the game reaches a designated quantity; (26) a total amount wagered on the game reaches a designated amount; (27) a total amount of credits or currency won by the player for the game reaches a designated amount won; (28) a total amount of credits or currency lost by the player for the game reaches a designated amount lost; (29) a time of day reaches a designated time of day; (30) a length of time the player has played the game reaches a designated length of time; (31) a play of a bonus game has not been provided within a designated period of time; (32) a play of a bonus game has not been provided within a designated quantity of plays of the game; (33) a designated quantity of consecutive winning outcomes of the game have been achieved; (34) a designated quantity of consecutive losing outcomes of the game have been achieved; (35) a credit balance of the player reaches a designated credit balance; (36) a change in frequency of play reaches a designated amount; (37) a ticket, coupon, or promotion is inserted or otherwise entered (such as by typing in a promotion code or scanning a barcode); (38) a designated quantity of credits is transferred onto the gaming system; (39) merchandise is purchased on the gaming system; (40) a contribution is made to charity through the use of the gaming system; (41) an update is posted onto a social networking website; (42) a status is changed on a social networking website; (43) a gaming establishment (such as a casino) is liked or shared via a social networking website; (44) an email address is supplied; (45) a survey is completed; (46) an input is made to the gaming system via an input device (described further below); (47) a designated point threshold is reached; (48) a designated time of year is reached; (49) at least a designated quantity of consecutive wins occurs; (50) at least a designated quantity of consecutive losses occurs; (51) an award that is less than the player's wager is won; (52) a randomly triggered mystery feature occurs; (53) a designated portion of a wheel is indicated following a spin of the wheel; (54) a designated offer (or multi-part offer) is accepted in an offer/acceptance game; (55) a designated rank is achieved in a skill-based game; (56) a designated point threshold is reached in a skill-based game; (57) a designated selection is picked in a selection game; (58) an opponent is defeated; (59) a designated rank is achieved in a multi-player game; (60) a new version of a game is played; (61) the player purchases a quantity of points using monetary credits or currency or non-monetary credits or currency (such as player tracking points); (62) a designated number of instances of consecutive tumbles occur in a tumbling reels game; (63) a designated number of tumbles occur across a number of bonus free spins in a tumbling reels game; (64) a designated number of tumbles occur across a designated number of plays of a tumbling reels game; and (65) a designated number of tumbles occur in each of a designated quantity of consecutive plays of a tumbling reels game.

In one embodiment, certain point accumulation events add points a single time whereas other point accumulation events add points each time they occur.

The quantity, amount, or number of points the gaming system accumulates for the player for a point accumulation event that occurs in association with the game may be any suitable quantity. For example, in various embodiments, the quantity of points is one or more of: (1) a static or predetermined quantity of points; (2) a randomly determined quantity of points; (3) based on the player's wager amount; (4) regardless or independent of the player's wager amount; (5) scaled based on the highest designated point threshold the player has reached so far; (6) based on a player tracking status or level of the player; (7) based on a time of day; (8) based on a time of year; (9) based on the denomination of the EGM (e.g., $0.01, $0.05, $0.10, $0.25, $0.50, $1, $5, etc.); (10) based on coin-in; (11) based on coin-out; (12) based at least in part on non-gaming activity; (13) based on a period of time for which the player has played the game; (14) determined based on the game; (15) determined based on a credit or currency balance of the player; and (16) determined based on the version of the game (e.g., a second version of the game provides points at a higher rate than a first version of the game).

The game may be associated with any suitable quantity of one or more designated point thresholds or levels. It should be appreciated that the quantity of designated point thresholds associated with the game may be predetermined, randomly determined, determined based on the game, or determined in any other suitable manner. In certain embodiments, the game is associated with a limited number of designated point thresholds (such as twenty or one hundred designated point thresholds), and in other embodiments the game is associated with an unlimited number of designated point thresholds. In one embodiment in which the game is associated with an unlimited number of designated point thresholds, after a certain point, when one of the designated point thresholds is reached, the gaming system modifies a feature(s) of and/or adds a new feature(s) to the game such that the average expected payback percentage of the game does not substantially increase. In another embodiment in which the game is associated with an unlimited number of designated point thresholds, after a certain point, when one of the designated point thresholds is reached, the gaming system modifies a feature(s) of and/or adds a new feature(s) to the game such that the average expected payback percentage of the game does not increase. In certain embodiments, the quantity of designated point thresholds associated with the game increases over time. In one example, the quantity of designated point thresholds increases when a new version of the game is released.

Each designated point threshold associated with the game may be associated with any suitable quantity of points that the player's point balance must meet or exceed for that designated point threshold to be reached. It should be appreciated that the quantity of points associated with the designated point thresholds may be predetermined, randomly determined, determined based on the game, or determined in any suitable manner. It should also be appreciated that, in certain embodiments, the quantity of points associated with the designated point thresholds may change over time. For instance, if it is determined that a designated point threshold is too difficult to achieve in a first release of a game, the second release of the game may reduce that designated point threshold to a more easily-obtainable quantity of points.

Further, the designated point thresholds associated with the game may be separated by any suitable quantities of points. In one embodiment, the designated point thresholds associated with the game are separated by a same quantity of points (e.g., a first designated point threshold of 10,000 points; a second designated point threshold of 20,000 points; a third designated point threshold of 30,000 points; a fourth designated point threshold of 40,000 points; and so on). In another embodiment, the designated point thresholds associated with the game are separated by increasing quantities of points (e.g., a first designated point threshold of 10,000 points; a second designated point threshold of 25,000 points; a third designated point threshold of 45,000 points; a fourth designated point threshold of 70,000 points; and so on). In a further embodiment, the designated point thresholds associated with the game are separated by decreasing quantities of points (e.g., a first designated point threshold of 10,000 points; a second designated point threshold of 50,000 points; a third designated point threshold of 85,000 points; a fourth designated point threshold of 105,000 points; and so on). In another embodiment, the designated point thresholds associated with the game are separated by randomly determined quantities of points (e.g., a first designated point threshold of 10,000 points; a second designated point threshold of 15,000 points; a third designated point threshold of 27,500 points; a fourth designated point threshold of 32,000 points; and so on).

It should be appreciated that, when a designated point threshold is reached (i.e., when the player's point balance meets or exceeds the quantity of points associated with that designated point threshold), the gaming system may modify any suitable feature(s) of the game and/or add any suitable new feature(s) to the game. For example, in various embodiments, when a designated point threshold is reached, the gaming system: (1) adds a new feature to the game, such as providing an additional pick or a hint in a selection game, or by reducing a threshold for a player to qualify for a certain game round or game award (i.e., the top level progressive award in a multi-level progressive game); (2) adds a new feature to a bonus game; (3) adds a new game; (4) adds a new bonus game; (5) adds a new art package for the game; (6) adds a new art package for a bonus game; (7) adds a new symbol set for the game; (8) adds a new symbol set for a bonus game; (9) adds new songs for the game; (10) adds new songs for a bonus game; (11) adds or activates new point accumulation events; (12) for one of the point accumulation events, increases the quantity of points the gaming system accumulates for the player when that point accumulation event occurs; (13) replaces one or more symbols with a wild symbol; (14) replaces one or more symbols with a bonus trigger symbol; (15) adds an extra payline to the game; (p) adds an extra payline to a bonus game; (16) provides a modifier applicable to any awards for the game; (17) provides a modifier applicable to any awards for a bonus game; (18) modifies the brightness of the game; (19) modifies the color scheme used for the game; (20) adds player customizable features for the game; (21) increases one of the awards in the paytable of the game; (22) adds a winning symbol combination to the paytable of the game; (23) replaces one or more symbols associated with lower awards with one or more symbols associated with higher awards; (24) replaces the paytable of the game with a more favorable paytable; (25) modifies the volatility of the game; (26) increases the probability of occurring of at least one winning symbol combination; (27) adds one or more progressive awards winnable by the player; (28) increases the top award; (29) increases the number of symbols; (30) modifies the order of the symbols on one or more reels; (31) modifies the proportion of the symbols on one or more reels; (32) modifies one or more winning symbol combinations; (33) increases the number of winning symbol combinations; (34) modifies the types of winning symbol combinations; (35) modifies the types of awards; (36) increases the frequency that awards are provided; (37) provides at least one additional chance in either the primary game or a bonus game, such as free spins in a reel game, additional selections in a selection game, or free cards or draws in a poker game; (38) provides at least one additional chance to win an award, such as a mystery award, which may or may not be associated with, or dependent on, either the primary game or a bonus game; (39) causes a notification to the player of a changed payback percentage (or hold percentage) associated with either the primary game or a bonus game; (40) causes at least one symbol overlay, such as a double symbol or a changed symbol for either the primary game or a bonus game; (41) increases an increment rate of one or more progressive awards associated with either the primary game or a bonus game; (42) adds a pick bonus to augment another feature (e.g., upon completion of a free spins bonus, enables the player to pick one of a plurality of selections to win additional free spins; upon an occurrence of a designated symbol combination, enables the player to pick one of a plurality of selections to win a modifier or an increase of an existing modifier); (43) changes one or more point accumulation rules (e.g., increases the quantity of points associated with a point accumulation event); (44) adds an additional wagering opportunity; (45) increases the average expected payback percentage associated with a variable multiplier feature; and/or (46) enables a strategic, knowledge, or physical skill-based feature or game.

In certain embodiments, not every modification made to a feature of the game and/or not every new feature added to the game increases the average expected payback percentage of the game. That is, in certain instances in these embodiments, when one of the designated point thresholds is reached, the gaming system modifies a feature(s) of the game and/or adds a new feature(s) to the game such that the average expected payback percentage of the game does not increase. In other embodiments, however, every modification made to a feature of the game and/or every new feature added to the game increases the average expected payback percentage of the game. That is, in these embodiments, when one of the designated point thresholds is reached, the gaming system modifies a feature(s) of the game and/or adds a new feature(s) to the game such that the average expected payback percentage of the game increases. In various embodiments, when one of the designated point thresholds is reached, the gaming system modifies a feature(s) of the game and/or adds a new feature(s) to the game that causes the average expected payback percentage of the game to increase, and also modifies a feature(s) of the game and/or adds a new feature(s) to the game that does not cause the average expected payback percentage of the game to increase.

In various embodiments, every modification made to a feature of the game and every new feature added to the game is permanent, regardless of whether those modifications or those new features increase the average expected payback percentage of the game. In other embodiments, only the modifications made to features of the game and the new features added to the game that increase the average expected payback percentage of the game are permanent. In certain such embodiments, the gaming system enables the player to disable or cancel any of the feature modifications or new features that do not increase the average expected payback percentage of the game. In other such embodiments, the gaming system enables the player to replace a feature modification or new feature that increases the average expected payback percentage of the game with a different feature modification or new feature that increases the average expected payback percentage of the game the same amount (or less than the same amount). For instance, the gaming system enables the player to replace a feature modification associated with an increase of the average expected payback percentage of the game by 0.01% with a different feature modification associated with an increase of the average expected payback percentage of the game by 0.01%.

The present disclosure contemplates that two different feature modifications and/or new features may change the average expected payback percentage by different amounts. For example, one feature modification or new feature increases the average expected payback percentage of the game by a total of 1% (e.g., increases the average expected payback percentage of the game from 92% to 93%), and another feature modification or new feature increases the average expected payback percentage by 0.25% percent (e.g., increases the average expected payback percentage of the game from 92% to 92.25%). In certain embodiments, however, each feature modification and/or new feature that changes the average expected payback percentage of the game does so by the same amount. In one such example, each feature modification and/or new feature changes the average expected payback percentage by a total of 0.01%. (e.g., 90% to 90.1%, 90.1% to 90.2%, and so forth)

In certain embodiments, as noted above, each designated point threshold associated with the game is associated with at least one feature modification and/or at least one new feature. In these embodiments, when that designated point threshold is reached, the gaming system modifies at least one existing feature of the game using that at least one feature modification and/or adds the at least one new feature to the game. In other embodiments, the gaming system is associated with a bank or pool of feature modifications and/or new features. In these embodiments, when one of the designated point thresholds is met, the gaming system selects one or more of the feature modifications and/or new features from the bank or pool and employs the selected feature modifications and/or adds the selected new features. It should be appreciated that that gaming system may make the selection in any suitable manner, such as randomly; based on the quantity of points associated with the reached designated point threshold; or based on player input (e.g., based on the player's selection of one of the feature modifications and/or new features). In further embodiments, the gaming system includes a plurality of groups of feature modifications and/or new features. In such embodiments, when the player's point balance reaches one of the designated point thresholds, the gaming system selects one or more of the feature modifications and/or new features from one or more of the groups to employ. It should be appreciated that that gaming system may make the selection in any suitable manner, such as randomly or based on the quantity of points associated with the reached designated point threshold. In one embodiment, the gaming system enables the player to create one or more of the groups.

In various embodiments, when the player's point balance reaches one of the designated point thresholds, the gaming system immediately employs the feature modification(s) associated with that designated point threshold to modify one or more features of the game and/or adds the new feature(s) associated with that designated point threshold to the game. In other embodiments, when the player's point balance reaches one of the designated point thresholds, the gaming system employs the feature modification(s) associated with that designated point threshold to modify one or more features of the game and/or adds the new feature(s) associated with that designated point threshold to the game prior to initiation of a subsequent play of the game. In further embodiments, when the player's point balance reaches one of the designated point thresholds, the gaming system employs the feature modification(s) associated with that designated point threshold to modify one or more features of the game and/or adds the new feature(s) associated with that designated point threshold to the game upon initiation of a subsequent gaming session of the player.

In other embodiments, when the player's point balance reaches one of the designated point thresholds, the gaming system employs the feature modification(s) associated with that designated point threshold to modify one or more features of the game and/or adds the new feature(s) associated with that designated point threshold to the game following a designated quantity of plays of the game. In further embodiments, when the player's point balance reaches one of the designated point thresholds, the gaming system employs the feature modification(s) associated with that designated point threshold to modify one or more features of the game and/or adds the new feature(s) associated with that designated point threshold to the game following a designated period of time.

In various embodiments, when the player's point balance reaches one of the designated point thresholds, the gaming system delays employing the feature modification(s) associated with that designated point threshold to modify one or more features of the game and/or adding the new feature(s) associated with that designated point threshold to the game when the modified and/or new feature(s) cause the average expected payback percentage of the game to increase. For example, certain regulations require a delay of at least a designated time period when changing the paytable of a gaming machine. In this example, when the modified and/or new features cause the average expected payback percentage of the game to increase, the gaming system delays employing such modifications and/or adding such new features until that designated time period has elapsed.

In one embodiment, rather than the player's gaming system increasing the average expected payback percentage of the game when the player's point balance reaches one of the designated point thresholds, the gaming establishment (such as the land-based or online casino) provides different gaming systems (such as EGMs) associated with different designated point thresholds. For instance, when a player's point balance reaches a designated point threshold, the player may play at a different EGM associated with that designated point threshold and having the increased average expected payback percentage (if any) associated with that designated point threshold. This enables an increase in average expected payback percentage without modifying the EGMs themselves. Such an embodiment could also be implemented online, such as providing different sets of playable games associated with each designated point threshold.

In certain embodiments, the gaming system informs the player of the designated point thresholds associated with each game. For instance, the gaming system may display the designated point thresholds on a primary display device or on a secondary display device (as described below), or may enable the player to make an input to the gaming system that causes the gaming system to display the designated point thresholds. In other embodiments, the gaming system does not inform the players of the designated point thresholds associated with any of the games.

In various embodiments, the gaming system informs the player of the amount the average expected payback percentage of the game increases when the player's point balance reaches a designated point threshold associated with the game. In various embodiments, the gaming system does so by displaying an indication that the average expected payback percentage of the game has increased and/or displaying the updated average expected payback percentage of the game (such as on a paytable screen or a help screen). In one embodiment, the gaming system displays such an indication without indicating the total average expected payback percentage. In another embodiment, the gaming system displays such an indication without indicating the amount by which the average expected payback percentage increased. In other embodiments, the gaming system does not inform the player of the amount the average expected payback percentage of the game increases when the player's point balance reaches a designated point threshold associated with the game.

In certain embodiments, the game is associated with a maximum average expected payback percentage that the average expected payback percentage of the game cannot exceed. In one such embodiment, once the average expected payback percentage of the game reaches the maximum average expected payback percentage, any further feature modifications or new features provided by the gaming system do not increase the average expected payback percentage of the game. In another such embodiment, the gaming system configures the designated point thresholds and associated increases in the average expected payback percentage such that no matter how often a player plays the game, the player (theoretically) can never cause the average expected payback percentage to exceed the maximum average expected payback percentage.

For example, a game's initial average expected payback percentage is 88%, and its maximum average expected payback percentage is 92%. In this example, the gaming system associates 10,000 designated point thresholds with the game, wherein each of the designated point thresholds is separated by 400 points. The gaming system determines and associates point accumulation events with the game such that the player can earn a maximum of 200 points per day. That is, a player who constantly plays the game can earn a maximum of 200 points per day. The gaming system associates a feature modification or a new feature with each designated point threshold that is associated with an increase of the average expected payback percentage of the game of 0.0004%. Thus, it would (theoretically) take a player over fifty-four years of constantly playing the game to increase the average expected payback percentage of the game to reach the maximum average expected payback percentage.

In another such embodiment, the gaming system configures the designated point thresholds and associated increases in the average expected payback percentage such that the player (theoretically) can cause the average expected payback percentage to reach the maximum average expected payback percentage. For example, a game's initial average expected payback percentage is 88%, and its maximum average expected payback percentage is 92%. In this example, the gaming system associates 500 designated point thresholds with the game, wherein each of the designated point thresholds is separated by 50 points. The gaming system determines and associates point accumulation events with the game such that the player can earn a maximum of 200 points per day. That is, a player who constantly plays the game can earn a maximum of 200 points per day. The gaming system associates a feature modification or a new feature with each designated point threshold that is associated with an increase of the average expected payback percentage of the game of 0.008%. Thus, it would (theoretically) take a player less than six months of constantly playing the game to increase the average expected payback percentage of the game to reach the maximum average expected payback percentage. This enables players who play at night or on weekends to achieve the maximum average expected payback percentage in a relatively short period of time.

In various embodiments, the gaming system changes the average expected payback percentage at least in part by changing the paytable of the game. In certain such embodiments, the gaming system is pre-loaded with one or more paytables that may be employed for the game. In another such embodiment, the gaming system is pre-loaded with all possible paytables that may be employed for the game. In other embodiments, the gaming system is configured to download a paytable associated with a given change in the average expected payback percentage of the game.

As noted above, in certain embodiments, the gaming system additionally enables the player to accumulate points for a game based on activities occurring outside of a casino or other gaming establishment. For example, the gaming system enables the player to play (and accumulate points while playing) an online wagering or non-wagering version of the game via the internet or a mobile wagering or non-wagering version of the game via a mobile network such as by using a smart phone or other suitable device. In one embodiment, any modification(s) to any feature(s) of the game are applied across all versions of the game (i.e., across all platforms), while in another embodiment any modification(s) to any feature(s) of the game are only applied to one platform of the game (such as the land-based version of the game).

In certain embodiments, the gaming system additionally enables the player to accumulate points for a game based on non-wagering versions of the game. In other embodiments, the gaming system additionally enables the player to accumulate points for the player for a game based on events unrelated to play of the game (e.g., staying at a particular casino or eating at a particular restaurant).

The present disclosure contemplates that the accumulated points for the player for each game are in addition to: (a) any monetary awards (e.g., currency or monetary credits) provided to or won by the player for the plays of the game; (b) any player tracking points accumulated for the player for playing or wagering on plays of the game; and (c) any other non-monetary or promotional credits provided to or accumulated by the player for the plays of the game. It should thus be appreciated that the gaming system of the present disclosure is different than a player tracking system in part because typical player tracking point systems are based on overall coin-in by the player and are not specifically related to, associated with, or usable in relation to individual games.

The present disclosure also contemplates, for a given game, the release of additional, follow-on, or updated versions of that game including additional designated point thresholds that the player's point balance can reach. It should be appreciated that, upon release of such additional, follow-on, or updated versions of that game, the gaming system automatically transfers the player's point balance from the previous version of that game to the new version of that game. That is, in these embodiments, the player does not re-start accumulating points to use in the new version of the game; rather, the player continues accumulating points into the point balance the player has built up via prior play of the game. In certain instances, the additional, follow-up, or updated version of the game includes modifications and/or new features that were not available in the prior version of the game. This provides incentive for players to continue playing a game even if they have already reached all designated point thresholds because a new version of that game, when released, will provide the players new modifications and/or features.

In certain instances, a player may have already accumulated enough points in the first version of the game to level up immediately when the second updated version of the game is released. For example, in a first version of a game, the highest designated point threshold is associated with 100,000 points. A player has accumulated 150,000 points for the game. A second version of the game is released, and has a first designated point threshold of 130,000 points. Thus, in this example, the player is provided the modification and/or the new feature associated with the first designated point threshold of the second version of the game because the player's point balance of 150,000 points for the game exceeds that threshold of 130,000 points. It should thus be appreciated that by releasing multiple versions of the same game with increased or upgraded content, players will be incentivized to continue playing a game in anticipation of a new version being released and, after the new version is released, old players who had stopped playing the game will be incentivized to return to the game to take advantage of the increased or upgraded content.

In certain embodiments, the gaming system employs one or more leader boards that display players' point balances. In such embodiments, these leader boards enable players to determine where they rank versus other players in terms of their point balances for each of the games. In one embodiment, the gaming system provides one or more points to the player for each designated period of time for which the player is in a designated position on the leader board. For example, the gaming system provides the player atop the leader board for a game with a designated quantity of points for each day that player is atop the leader board.

Referring now to FIG. 1, FIG. 1 illustrates a flowchart of a process or method 100 for operating an example embodiment of the gaming system of the present disclosure. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example, the gaming system receives an input from a player to initiate a play of a game, as indicated by block 102. The gaming system displays the play of the game, as indicated by block 104. The gaming system determines whether a point accumulation event occurred in association with the play of the game, as indicated by diamond 106. If the gaming system determines that a point accumulation event did not occur, process 100 returns to block 102. If the gaming system determines that a point accumulation event occurred, the gaming system adds one or more points to a point balance of the player for the game, as indicated in block 108.

The gaming system determines whether the player's point balance for the game reached one of a plurality of designated point thresholds associated with the game, as indicated by diamond 110. If the gaming system determines that the player's point balance for the game did not reach one of the designated point thresholds, process 100 proceeds to diamond 114, described below. If the gaming system determines that the player's point balance for the game reached one of the designated point thresholds, the gaming system modifies a feature of the game and/or adds a new feature to the game such that the average expected payback percentage of the game permanently increases, as indicated by block 112.

The gaming system determines whether another point accumulation event occurred in association with the play of the game, as indicated by diamond 114. If the gaming system determines that another point accumulation event did not occur, process 100 returns to block 102. If the gaming system determines that another point accumulation event occurred, process 100 returns to block 108.

FIGS. 2, 3, 4, and 5 illustrate tables 200, 300, 400, and 500, respectively. Tables 200, 300, 400, and 500 include different example sets of designated point thresholds that may be associated with a game. More specifically, tables 200, 300, 400, and 500 include, for each designated point threshold: (a) the point balance needed to reach that designated point threshold, (b) the feature modification (if any) associated with that designated point threshold, (c) the new feature (if any) associated with that designated point threshold, (d) the average expected payback percentage prior to the gaming system modifying a feature of the game or adding a new feature to the game in association with that designated point threshold being reached, and (e) the average expected payback percentage of the game after the gaming system modifies a feature of the game or adds a new feature to the game in association with that designated point threshold being reached.

Turning to FIG. 2, table 200 includes a set of ten designated point thresholds associated with the game. Each designated point threshold in this example is separated by a same quantity of points (i.e., 5,000 points in this example). Each designated point threshold in this example is associated with a modification of a feature of the game or a new feature that, when employed in the game, increases the average expected payback percentage of the game by 0.1%. That is, in this example, each modification of a feature of the game and each new feature added to the game increases the average expected payback percentage of the game by a same amount of 0.1%.

Turning to FIG. 3, table 300 includes a set of ten designated point thresholds associated with the game. The quantity of points separating the designated point thresholds in this example increases as the designated point thresholds increase. For instance, 5,000 points separate designated point thresholds 1 and 2, but 30,000 points separate designated point thresholds 5 and 6. Each designated point threshold in this example is associated with a modification of a feature of the game or a new feature that, when employed in the game, increases the average expected payback percentage of the game. In this example, higher designated point thresholds are associated with feature modifications or new features that, when employed in the game, increase the average expected payback percentage by greater amount than the feature modifications or new features associated with lower designated point thresholds.

Turning to FIG. 4, table 400 includes a set of ten designated point thresholds associated with the game. In this example, the first five designated point thresholds are associated with feature modifications or new features that, when employed in the game, increase the average expected payback percentage of the game. The remaining five designated point thresholds are associated with feature modifications or new features that, when employed in the game, do not increase the average expected payback percentage of the game. In this example, the quantity of points separating the designated point thresholds associated with an increased average expected payback percentage increases as the designated point thresholds increase. For instance, 10,000 points separate designated point thresholds 1 and 2, but 20,000 points separate designated point thresholds 2 and 3. Further, the quantity of points separating each designated point threshold that is not associated with an increased average expected payback percentage is the same (i.e., 10,000 points in this example).

In this example, with respect to the first five designated point thresholds, each of those five designated point thresholds is associated with a modification of a feature of the game or a new feature that, when employed in the game, increases the average expected payback percentage of the game by 0.2%. That is, in this example, each modification of a feature of the game and each new feature added to the game that increases the average expected payback percentage of the game does so by a same amount of 0.2%.

Turning to FIG. 5, table 500 includes a set of ten designated point thresholds associated with the game. In this example, certain of the designated point thresholds are associated with feature modifications or new features that, when employed in the game, increase the average expected payback percentage of the game. Certain other of the designated point thresholds are associated with feature modifications or new features that, when employed in the game, do not increase the average expected payback percentage of the game. In this example, the quantity of points separating the designated point thresholds was randomly determined. For instance, 12,500 points separate designated point thresholds 1 and 2, but 5,000 points separate designated point thresholds 9 and 10. In this example, each of the designated point thresholds associated with an increased average expected payback percentage is associated with a modification of a feature of the game or a new feature that, when employed in the game, increases the average expected payback percentage of the game by an amount that was randomly determined. For example, designated point threshold 5 is associated with a 1% increase in the average expected payback percentage of the game, and designated point threshold 7 is associated with a 0.6% increase in the average expected payback percentage of the game.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines (EGMs); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 6A:
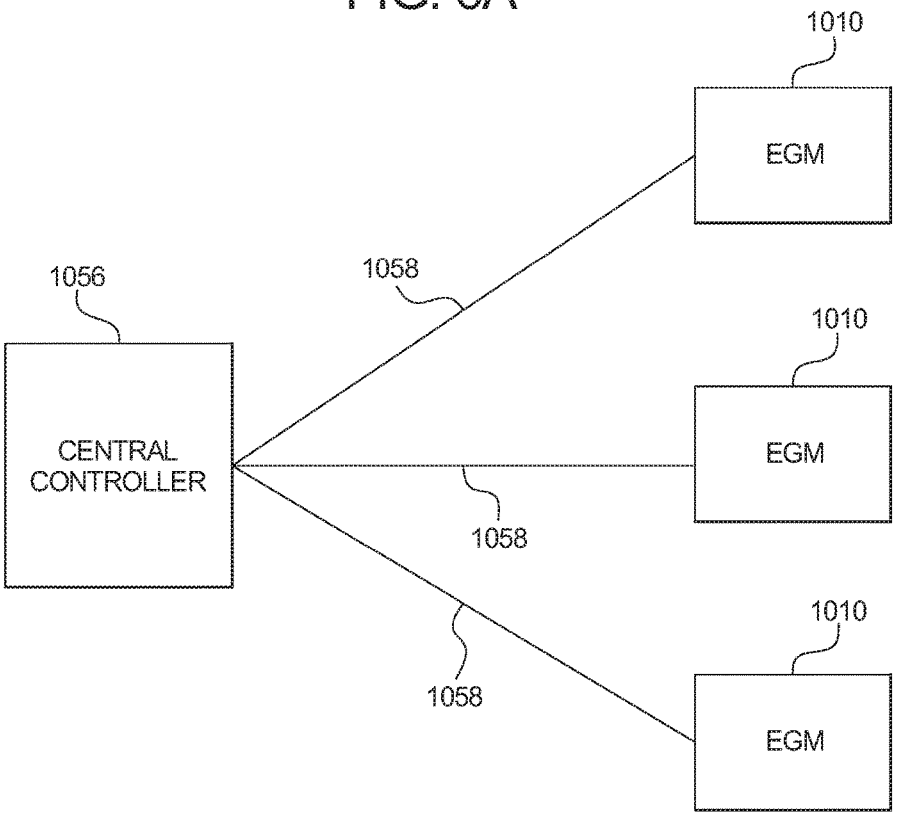
FIG. 6A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 6A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 6B:
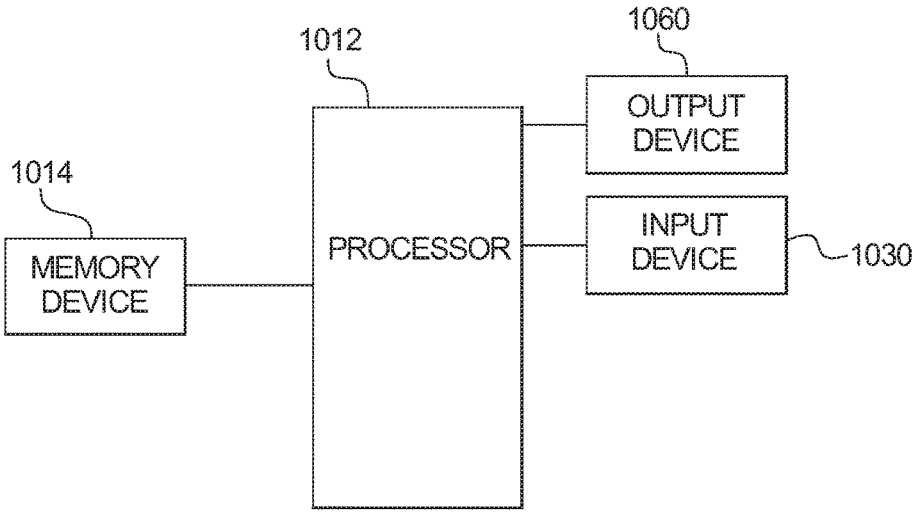
FIG. 6B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 6B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 6B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

In various embodiments, the EGM includes one or more input devices. The input devices may include any suitable device that enables an input signal to be produced and received by the at least one processor of the EGM. The example EGM illustrated in FIG. 6B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof.

Figure 7A:
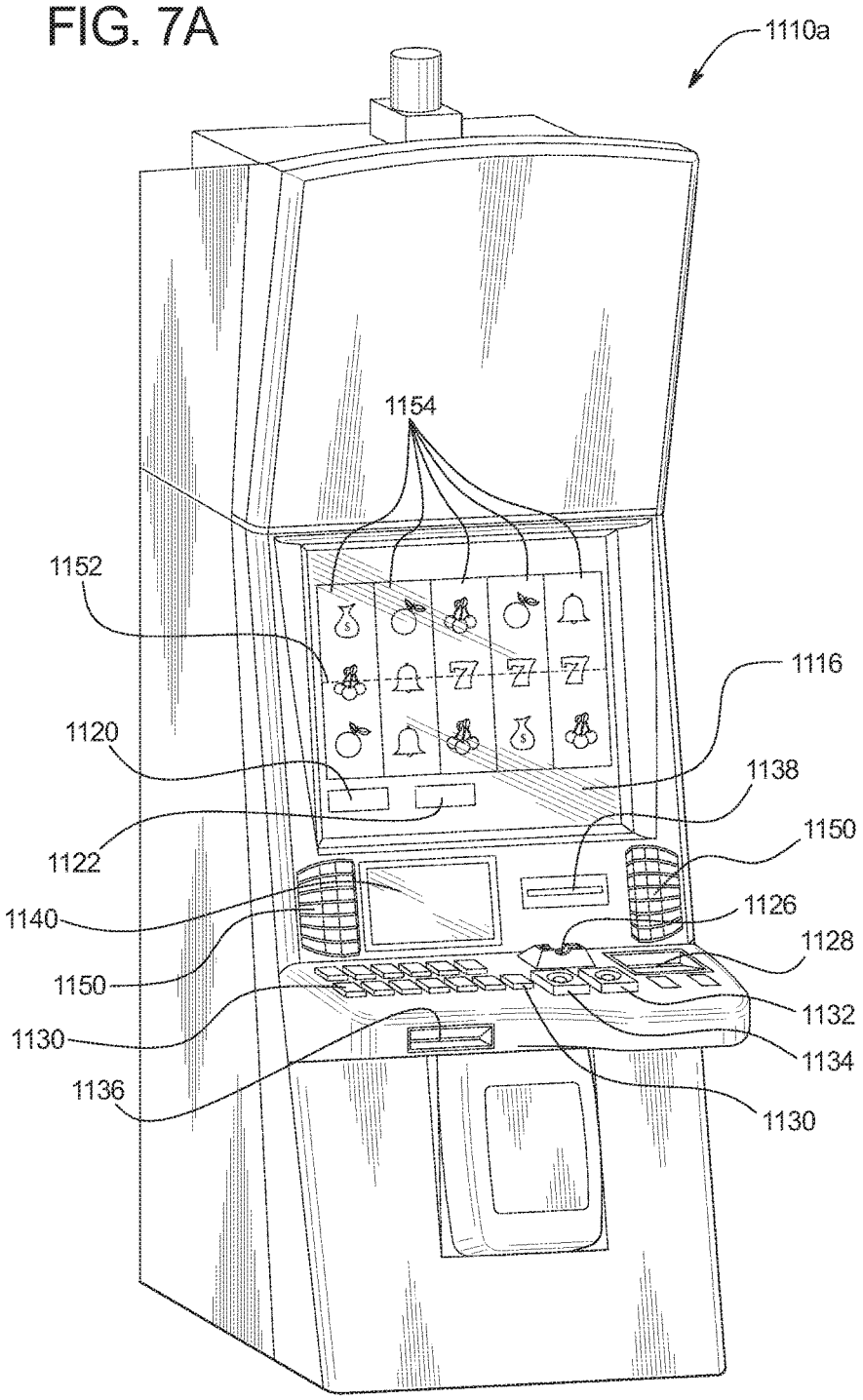
FIGS. 7A and 7B are perspective views of example alternative embodiments of the gaming system of the present disclosure.
Figure 7B:
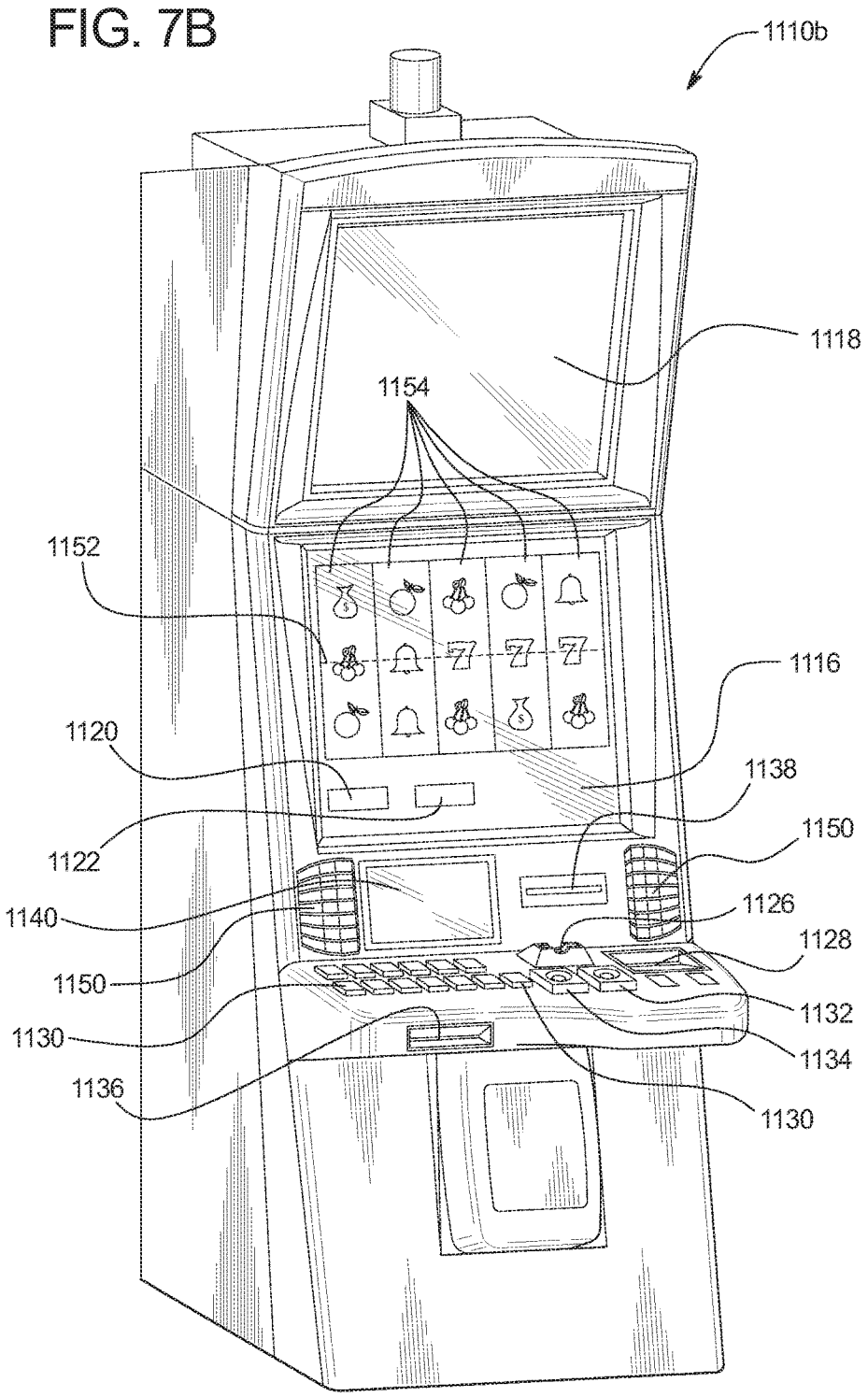

FIGS. 7A and 7B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 7A and 7B each include a game play activation device in the form of a game play initiation button 1132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 7A and 7B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 7A and 7B each include a card reader 1138. The card reader is configured to read a player identification card inserted into the card reader.

In various embodiments, the EGM includes one or more output devices. The example EGM illustrated in FIG. 6B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 6A includes a central display device 1116, a player tracking display 1140, a credit display 1120, and a bet display 1122. The example EGM illustrated in FIG. 6B includes a central display device 1116, an upper display device 1118, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 7A and 7B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 7A and 7B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 7A and 7B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 7A and 7B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 7A and 7B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method comprising:

identifying a player through a device remote from a server;

initiating a gaming session of the player through the remote device;

after the player has been identified and during the gaming session of the player, randomly determining, by a processor of the server communicatively coupled with the remote device, an outcome for a first play of a game, wherein the game has an average expected payback percentage;

causing the processor to communicate display data to the remote device to cause a display device of the remote device to display the outcome;

responsive to a first modification event occuring in association with the first play of the game, modifying, by the processor, the game in a first manner so the average expected payback percentage of the game for at least one of any subsequent plays of the game during the gaming session is greater than the average expected payback percentage of the game for the first play of the game; and responsive to a second modification event occuring in association with the first play of the game, modifying, by the processor, the game in a second manner different from the first manner for at least one of any subsequent plays of the game during the gaming session, the second manner of modification not causing the average expected payback percentage of the game to increase, wherein one of the first modification event and the second modification event occurs based on a point balance associated with the player.

2. The method of claim 1, further comprising increasing, by the processor, the quantity of accumulated items associated with the player responsive to an occurrence of an item increase event in association with the first play of the game.

3. The method of claim 1, wherein causing, by the processor, the display device to display the outcome comprises causing, by the processor, data associated with the outcome to be transmitted.

4. The method of claim 3, wherein causing, by the processor, the data associated with the outcome to be transmitted comprises causing, by the processor, the data associated with the outcome to be transmitted over a data network.

5. The method of claim 4 wherein the data network is the Internet.

6. The method of claim 1, further comprising, after the player has been identified and during a second gaming session of the player subsequent to the gaming session of the player, randomly determining, by the processor, an outcome for a second play of the game, wherein if the first modification event occurred in association with the first play of the game, the average expected payback percentage of the game for the second play of the game is greater than the average expected payback percentage of the game for the first play of the game.

7. The method of claim 1, further comprising, if the first modification event occurs in association with the first play of the game, modifying, by the processor, the game in the first manner so the average expected payback percentage of the game for each of any subsequent plays of the game during the gaming session is greater than the average expected payback percentage of the game for the first play of the game.

8. The method of claim 1, further comprising, if the first and second modification events both occur in association with the first play of the game, modifying, by the processor, the game in both the first manner and the second manner so the average expected payback percentage of the game for at least one of any subsequent plays of the game during the gaming session is greater than the average expected payback percentage of the game for the first play of the game.

9. A system comprising:

a server configured to be communicatively coupled to a remote device to identify a player and initiate a clamming session of the player, the remote device including a display device, said server comprising:

a processor; and a memory device that stores instructions that, when executed by the processor, cause the processor to:

after the player has been identified and during the gaming session of the player, randomly determine an outcome for a first play of a game, wherein the game has an average expected payback percentage;

cause the display device to display the outcome;

responsive to a first modification event occurring in association with the first play of the game, modify the game in a first manner so the average expected payback percentage of the game for at least one of any subsequent plays of the game during the gaming session is greater than the average expected payback percentage of the game for the first play of the game; and responsive to a second modification event occuring in association with the first play of the game, modify the game in a second manner different from the first manner for at least one of any subsequent plays of the game during the gaming session, the second manner of modification not causing the average expected payback percentage of the game to increase, wherein one of the first modification event the second modification event occurs depending on a point balance associated with the player.

10. The system of claim 9, wherein the instructions, when executed by the processor, cause the processor to increase the quantity of accumulated items associated with the player responsive to an occurrence of an item increase event in association with the first play of the game.

11. The system of claim 9, wherein the instructions, when executed by the processor, cause the processor to cause the display device to display the outcome by causing data associated with the outcome to be transmitted.

12. The system of claim 11, wherein the instructions, when executed by the processor, cause the processor to cause the data associated with the outcome to be transmitted by causing the data associated with the outcome to be transmitted over a data network.

13. The system of claim 12, wherein the data network is the Internet.

14. The system of claim 9, wherein the instructions, when executed by the processor, cause the processor to, after the player has been identified and during a second gaming session of the player subsequent to the gaming session of the player, randomly determine an outcome for a second play of the game, wherein if the first modification event occurred in association with the first play of the game, the average expected payback percentage of the game for the second play of the game is greater than the average expected payback percentage of the game for the first play of the game.

15. The system of claim 9, wherein the instructions, when executed by the processor, cause the processor to, if the first modification event occurs in association with the first play of the game, modify the game in the first manner so the average expected payback percentage of the game for each of any subsequent plays of the game during the gaming session is greater than the average expected payback percentage of the game for the first play of the game.

16. The system of claim 9, wherein the instructions, when executed by the processor, cause the processor to, if the first and second modification events both occur in association with the first play of the game, modify the game in both the first manner and the second manner so the average expected payback percentage of the game for at least one of any subsequent plays of the game during the gaming session is greater than the average expected payback percentage of the game for the first play of the game.

* * * * *